US007183725B2

(12) United States Patent
Kim

(10) Patent No.: US 7,183,725 B2
(45) Date of Patent: Feb. 27, 2007

(54) BACKLIGHT INVERTER SYSTEM AND CONTROL METHOD FOR STARTING THE SAME

(75) Inventor: Jae-hyun Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 50 days.

(21) Appl. No.: 11/017,078

(22) Filed: Dec. 21, 2004

(65) Prior Publication Data

US 2005/0168172 A1 Aug. 4, 2005

(30) Foreign Application Priority Data

Jan. 29, 2004 (KR) ..... 10-2004-0005695

(51) Int. Cl.
*G05F 1/00* (2006.01)

(52) U.S. Cl. ..... 315/291; 315/224; 315/307; 315/209 R; 345/102

(58) Field of Classification Search ..... 315/291, 315/224, 307, 209 R, DIG. 5, DIG. 7; 345/102; 361/91.2, 93.8
See application file for complete search history.

(56) References Cited

U.S. PATENT DOCUMENTS 5,705,877 A * 1/1998 Shimada ..... 310/318
6,469,454 B1 * 10/2002 Mader et al. ..... 315/291
6,498,437 B1 * 12/2002 Chang et al. ..... 315/141
6,633,138 B2 * 10/2003 Shannon et al. ..... 315/224
2004/0041782 A1 * 3/2004 Tachibana ..... 345/102

FOREIGN PATENT DOCUMENTS

| | | |
|---|---|---|
| JP | 06-118381 | 4/1994 |
| JP | 11-160674 | 6/1999 |
| KR | 1998-066276 | 10/1998 |
| KR | 2002-0017358 | 3/2002 |
| KR | 2003-0055616 | 7/2003 |

* cited by examiner

*Primary Examiner*—Haissa Philogene
(74) *Attorney, Agent, or Firm*—Roylance, Abrams, Berdo & Goodman, L.L.P.

(57) ABSTRACT

A backlight inverter system and a start-up control method thereof to apply an optimal start-up voltage to a backlight lamp according to an environment temperature, such that the backlight lamp is stably started without damage to the system. If the backlight lamp is not started in the normal condition, the start-up voltage level is gradually increased. The start-up voltage level is adjusted by controlling an amount of electric current flowing into the backlight lamp by using a plurality of parallel-connected capacitors, each having a switching element. If an abnormal electric current is detected in the backlight inverter system, an automatic shut-down function is further performed to automatically stop the system, thereby protecting the system from an overcurrent.

7 Claims, 3 Drawing Sheets

BACKLIGHT INVERTER SYSTEM AND CONTROL METHOD FOR STARTING THE SAME

CROSS-REFERENCE TO RELATED APPLICATIONS

This application claims the benefit under 35 U.S.C. §119 (a) of Korean Patent Application No. 2004-05695, filed in the Korean Intellectual Property Office on Jan. 29, 2004, the entire contents of which are incorporated herein by reference.

BACKGROUND OF THE INVENTION

1. Field of the Invention

The present invention relates to a backlight inverter system. More particularly, the present invention relates to a backlight inverter system which is capable of stably starting a backlight when power is supplied to the system for the first time and for driving a backlight lamp in a normal condition, and a control method for starting the same.

2. Description of the Related Art

Compact and light LCD (Liquid Crystal Display) devices have been increasingly employed as viewfinder displays. Since the LCD works on the principle of receiving light rather than emitting light, a backlight of high transmissivity attached to a rear surface of a liquid crystal plate of the LCD renders image information displayed on the LCD clearer with a uniform luminance. The backlight typically uses a backlight lamp to emit light, which is fabricated by downsizing a general fluorescent light lamp into a suitable size for the backlight. Even with a small size, the backlight lamp has an efficiency that rivals that of the fluorescent light lamp.

The backlight lamp contains therein a positive and a negative (i.e., +, −) discharge electrode, a mercurial vapor, an argon gas, and a fluorescent membrane which is coated on the outer surface of the lamp. When a voltage is applied to the discharge electrode, the inner gases collide with one another and heat the fluorescent membrane, thereby generating light. In order to start the backlight lamp with power supplied to the LCD, a voltage higher than that of a normal condition, and sufficient to activate the inside of the lamp, must be applied.

In order to normally start a backlight inverter system at a low temperature, a voltage higher than that typically applied at a high temperature is required. If a start-up voltage suitable for a low temperature condition is applied at a high temperature, an automatic shut-down function has to be performed to prevent damage to the inside of the backlight. However, the shut-down function may not always be achieved, which can result in damage to the system. In order to solve this problem, some attempted solutions adopt a passive and dependent method that apply an intermediate voltage value to prevent problems at both high and low temperatures.

Accordingly, a need exists for a method and system that overcomes the deficiencies of prior attempted solutions by stably starting a backlight inverter system according to the ambient temperature without harm or damage to the system.

SUMMARY OF THE INVENTION

The present invention has been developed in order to solve the above and other problems in the related art. Accordingly, an object of the present invention is to provide a backlight inverter system which is capable of achieving a stable start-up operation by incrementing a start-up voltage to a predetermined level when the backlight is in off-state, and by applying a normal voltage when the backlight is turned on, and a start-up control method thereof.

The above objects are achieved by providing a backlight inverter system comprising a pulse generator for generating a first pulse to start a backlight lamp, the pulse generator generating a second pulse for a normal operation after the backlight lamp is started, and a high voltage generator for generating a high frequency voltage corresponding to the pulses output from the pulse generator and for applying a predetermined level of start-up voltage and a normal voltage to the backlight lamp. When a start-up voltage suitable to the present temperature is applied to the backlight lamp, the backlight lamp exhibits a high luminance. When it is determined that the backlight lamp is started in the normal condition, a lamp driving detector outputs a corresponding signal to the pulse generator to generate the second pulse. If the lamp driving detector detects that the backlight lamp is not started, it outputs a corresponding signal to a start-up voltage adjuster to increase the level of the start-up voltage.

The start-up voltage adjuster comprises at least one, i.e., first capacitor, connected to a node that connects the high voltage generator and the backlight lamp, and having one end connected to a grounded electrode, and at least one, i.e., second capacitor, serially connected to the first capacitor and having a switching element. The switching element is turned on or off according to a signal output from the lamp driving detector.

The backlight inverter system further comprises an abnormal electric current detector. If an abnormal electric current is detected in a branch including the first capacitor, the abnormal electric current detector outputs a corresponding signal to the pulse generator to stop the operation, and protects the system from the overcurrent.

BRIEF DESCRIPTION OF THE DRAWINGS

The above objects and other advantages of the present invention will become more apparent by describing an embodiment of the present invention with reference to the accompanying drawings, in which.

Throughout the drawings, like reference numerals will be understood to refer to like parts, components and structures.

DETAILED DESCRIPTION OF THE EXEMPLARY EMBODIMENTS

Hereinafter, the present invention is described in greater detail with reference to the accompanying drawings.

Figure 1:
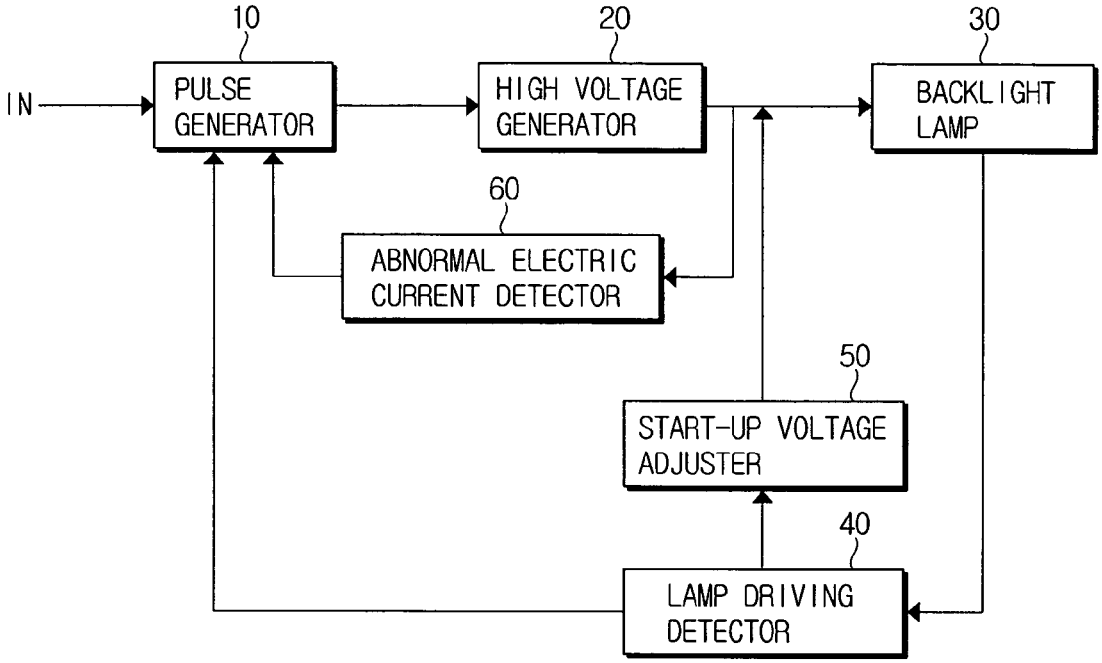
FIG. 1 is a block diagram showing a backlight inverter system according to an embodiment of the present invention.

FIG. 1 is a block diagram showing a backlight inverter system according to an embodiment of the present invention. Referring to FIG. 1, the backlight inverter system comprises a pulse generator 10 for generating a pulse having a predetermined period and a predetermined width, a high voltage generator 20 being input with the pulse to generate a high frequency, high voltage, a backlight lamp 30 emitting light with the high voltage being supplied to a discharge electrode (not shown) of the backlight lamp 30, a lamp driving detector 40 for detecting whether the backlight lamp 30 is operated under a normal condition, a start-up voltage adjuster 50 for incrementing the voltage level when the high voltage is not sufficiently high enough to start the backlight lamp 30, and an abnormal electric current detector 60.

To provide a light source having a high brightness to the LCD display (not shown), a high voltage of approximately 1 kV is preferably applied to the discharge electrode of the backlight lamp 30. Hereinbelow, a voltage initially applied to the backlight lamp 30 is called a 'start-up voltage', and a voltage applied after the backlight lamp 30 is stably started-up is called a 'normal voltage'. The start-up voltage needed at the initial period is typically higher than the normal voltage. The lower the ambient temperature, the higher the start-up voltage required to start the backlight lamp 30.

As power is applied to the LCD, the pulse generator 10 is generally applied with a +5V direct current voltage Vcc input IN, which is a driving command signal with respect to the backlight lamp 30.

When being applied with the direct current voltage Vcc, the pulse generator 10 generates a PWM (Pulse Width Modulation) waveform and a PFM (Pulse Frequency Modulation) waveform, and outputs the same to the high voltage generator 20. The pulse generator 10 has a switch (not shown) disposed therein. According to the switching operation of the switch, the pulse generator 10 outputs a waveform having a small or large pulse width in the initial period, and outputs a waveform having a large or small pulse width, respectively, after the backlight lamp 30 is started and normally operated. The switching operation is controlled by a feedback voltage generated by an electric current flowing through the backlight lamp 30.

The high voltage generator 20 generates the high frequency, high voltage by amplifying the pulse signal, thereby allowing a predetermined electric current flow through the backlight lamp 30. When the backlight lamp 30 is normally started, with the high voltage supplied corresponding to the electric current flowing through the backlight lamp 30, the backlight lamp 30 emits light and provides uniform light of high luminance to the LCD.

The lamp driving detector 40 can be embodied by a feedback circuit which rectifies and filters the voltage, corresponding to the electric current flowing through the backlight lamp 30, to generate the feedback voltage. Based on the feedback voltage, the lamp driving detector 40 detects whether the backlight lamp 30 is operating normally or abnormally. If the backlight lamp 30 is not determined to be turned-on, the lamp driving detector 40 outputs a corresponding signal to the start-up voltage adjuster 50. If the backlight lamp 30 is determined to be turned-on and operating normally, the lamp driving detector 40 outputs a corresponding signal to the pulse generator 10 and the backlight lamp 30.

The start-up voltage adjuster 50 adjusts a level of the start-up voltage for the backlight lamp 30 according to the signal output from the lamp driving detector 40.

Figure 2:
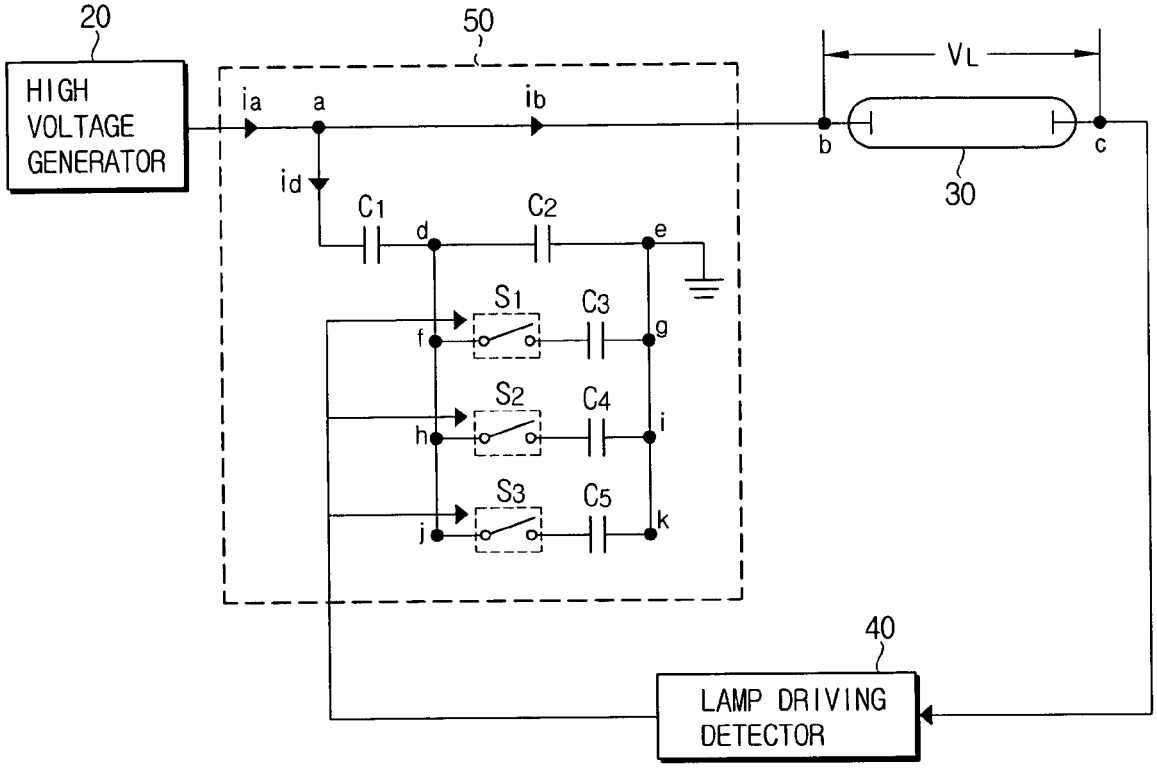
FIG. 2 is a schematic showing the start-up voltage adjuster of FIG. 1.

FIG. 2 is a schematic showing an example of the start-up voltage adjuster 50 of FIG. 1. Referring to FIG. 2, a node 'a' on a branch which connects the high voltage generator 20 and the backlight lamp 30, is serially connected to first and second capacitors C1 and C2. The second capacitor C2 is connected to a grounded electrode. A predetermined number of capacitors C3, C4, and C5, each including a switching element S1, S2, and S3, respectively, are connected parallel to the second capacitor C2. The respective switching elements S1, S2, and S3 are controlled according to an input signal from the lamp driving detector 40.

An electric current $i_a$, which flows into the node 'a' by the high voltage generated by the high voltage generator 20, is branched into an electric current $i_b$ to flow into the backlight lamp 30, and an electric current $i_d$ to flow into the start-up voltage adjuster 50. A voltage $V_L$ exerted across the backlight lamp 30, is in proportion to the magnitude of the electric current $i_b$ flowing through the backlight lamp 30. Therefore, by adjusting the magnitude of the electric current $i_b$ flowing through the backlight lamp 30, the stable start-up of the backlight lamp 30 is possible.

The magnitude of the electric current $i_b$ flowing through the backlight lamp 30 depends on the on-off states of the switching elements S1, S2, and S3. In this embodiment, if all of the switching elements S1, S2, and S3 are in on-state, the electric current $i_b$ flowing through the backlight lamp 30 has a minimum value, while if all of the switching elements are in off-state, the electric current $i_b$ has a maximum value. Accordingly, when a direct current voltage is applied to the pulse generator 10 to generate a predetermined pulse for driving the backlight via a high voltage, the switching elements S1, S2, and S3 are controlled to be in an on-state. At this time, if the backlight lamp 30 is not turned-on, a certain switching element, such as S3 is turned off to increase the start-up voltage level. If the increase of the start-up voltage level is not sufficient to then turn on the backlight lamp 30, another switching element, such as S2 is turned off to further increase the start-up voltage level. In this manner, the startup voltage level is gradually increased within a safe range and not adversely affecting the system. When the backlight lamp 30 is turned on, the pulse generator 10 then generates and outputs a pulse for the normal voltage supply according to a signal from the lamp driving detector 40.

Returning to FIG. 1, the abnormal electric current detector 60 receives the electric current $i_d$ flowing through the start-up driving voltage adjuster 50, and if the electric current $i_d$ is greater than or equal to a predetermined reference value, the detector 60 determines that the backlight lamp 30 is opened or the system is damaged, and sends a signal directing the pulse generator 10 to perform an automatic shut-down function.

The backlight converter system with the above construction, flexibly supplies the start-up voltage according to the environment temperature, thereby allowing the backlight lamp to be stably started without damaging the system.

Hereinafter, a start-up control method of the backlight inverter system will be described.

Figure 3:
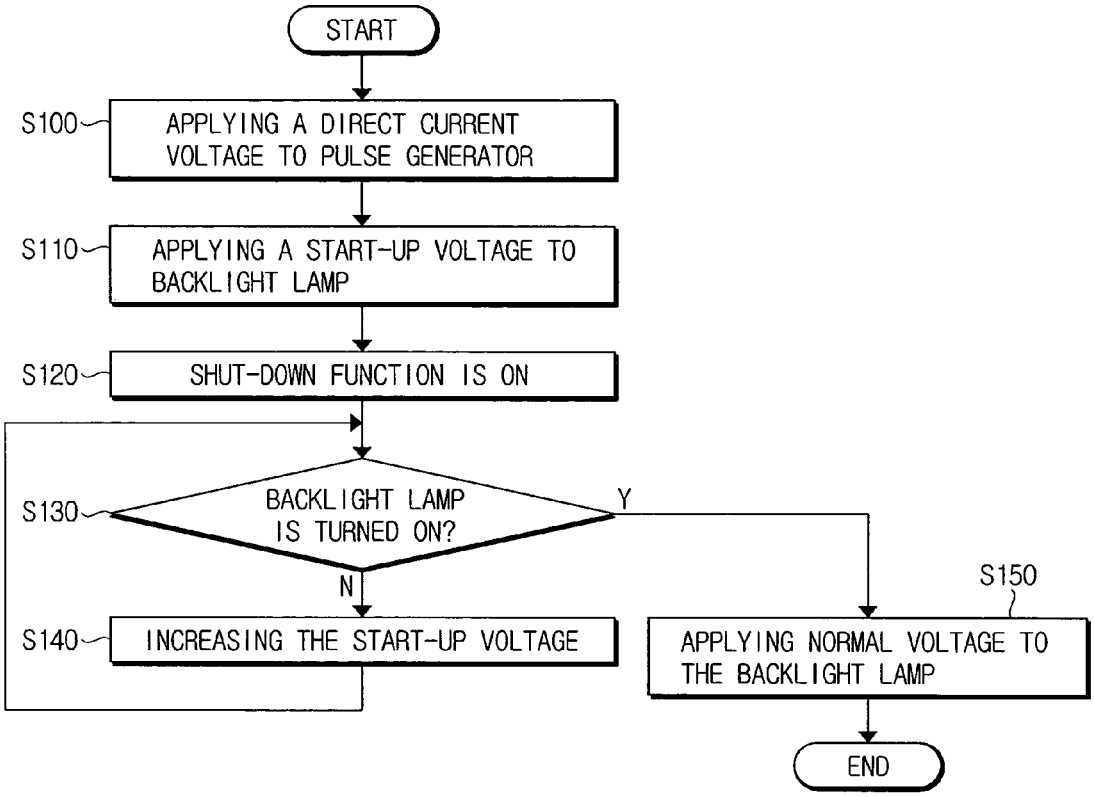
FIG. 3 is a flowchart showing a start-up control method of the backlight inverter system according to an embodiment of the present invention.

FIG. 3 is a flowchart showing a start-up control method of the backlight inverter system according to an embodiment of the present invention. Referring to FIG. 3, when a predetermined direct current voltage Vcc is applied to the pulse generator 10 with power supplied to the LCD at step S100, the pulse generator 10 generates and outputs a first predetermined pulse signal to drive the backlight lamp 30, and a high voltage generator 20 generates a high voltage corresponding to the first pulse signal to allow a predetermined electric current to flow through the backlight lamp 30 at step S110. When the backlight lamp 30 is opened or the electric current over-flows through the backlight lamp, which indicates an abnormal electric current generation, an automatic shut-down function is executed to stop the pulse generator 10 at step S120.

It is further determined whether the backlight lamp is normally turned-on by the applied start-up voltage from a feedback voltage signal at step S130. When the backlight lamp 30 is not turned-on, the start-up voltage level is increased by a predetermined amount at step S140. The steps of S130 and S140 are then repeated within the predetermined voltage level until the backlight lamp 30 is turned on. In the step of S130, if it is determined that the backlight lamp 30 is turned on, a normal voltage is applied to the backlight lamp 30 at step S150.

As described above, since an optimal start-up voltage is applied to turn on the backlight lamp 30 each time, the unnecessary consumption of the high voltage can be eliminated. Accordingly, it is possible to provide a backlight inverter system that is capable of being stably started-up according to the environment temperature. Also, the automatic shut-down function can prevent damage which may be caused by abnormal electric current.

Although an exemplary embodiment of the present invention has been described, it will be understood by those skilled in the art that the present invention should not be limited to the described embodiments, but various changes and modifications can be made within the spirit and scope of the present invention as defined by the appended claims.

What is claimed is:

1. A backlight inverter system comprising:

a pulse generator for generating a first pulse to start a backlight lamp, the pulse generator generating a second pulse for a normal operation after the backlight lamp is started;

a high voltage generator for generating a high frequency voltage corresponding to the pulses output from the pulse generator and for applying at least one of a predetermined level of start-up voltage and a normal voltage to the backlight lamp;

a start-up voltage adjuster for adjusting the level of start-up voltage applied to the backlight lamp; and a lamp driving detector for detecting if the backlight lamp is started and for outputting a corresponding signal to the pulse generator to generate the second pulse if the lamp is started, and for detecting if the backlight lamp is not started and for outputting a corresponding signal to the start-up voltage adjuster to increase the level of the start-up voltage if the lamp is not started.

2. The backlight inverter system as claimed in claim 1, wherein the start-up voltage adjuster comprises:

at least a first capacitor having first and second terminals, the first capacitor being connected to a node that connects the high voltage generator and the backlight lamp, and having the first terminal connected to a grounded electrode; and at least a second capacitor having first and second terminals, the second capacitor being serially connected to the first capacitor and having a switching element.

3. The backlight inverter system as claimed in claim 2, wherein the switching element is turned on or off according to a signal output from the lamp driving detector.

4. The backlight inverter system as claimed in claim 1, further comprising an abnormal electric current detector for detecting an abnormal electric current flowing through a branch including the first capacitor, wherein if the abnormal electric current is detected, the abnormal electric current detector outputting a corresponding signal to the pulse generator to stop the operation.

5. A start-up method of a backlight inverter system comprising the steps of:

(a) generating a first level of high voltage to start a backlight lamp, and applying a predetermined start-up voltage to the backlight lamp if a predetermined direct current voltage is applied;

(b) determining whether the backlight lamp is started in a normal condition;

(c) increasing the start-up voltage applied to the backlight lamp if it is determined that backlight lamp is not started in the step of (b);

(d) generating a second level of high voltage for the normal operation of the backlight lamp, and applying a predetermined normal voltage to the backlight lamp if it is determined that backlight lamp is started in the step of (b).

6. The start-up method as claimed in claim 5, further comprising the steps of:

adjusting a level of the start-up voltage in the step of (c) by connecting a plurality of parallel-connected capacitors, each having a switching element, to a node connected to the backlight lamp; and controlling the amount of electric current flowing through the backlight lamp according to an on-off state of the switching elements.

7. The start-up method as claimed in claim 6, further comprising of the step of:

stopping the operation of the system if an abnormal electric current flows through at least one parallel-connected capacitor.

* * * * *